United States Patent [19]

Kishimoto et al.

[11] Patent Number: 4,481,290

[45] Date of Patent: Nov. 6, 1984

[54] COLOR PHOTOGRAPHIC SILVER HALIDE LIGHT-SENSITIVE MATERIALS

[75] Inventors: Shinzo Kishimoto; Kiyohiko Yamamuro, both of Kanagawa, Japan

[73] Assignee: Fuji Photo Film Co., Ltd., Kanagawa, Japan

[21] Appl. No.: 480,045

[22] Filed: Mar. 29, 1983

[30] Foreign Application Priority Data

Mar. 29, 1982 [JP] Japan ..... 57-50368

[51] Int. Cl.[3] ..... G03C 7/26

[52] U.S. Cl. ..... 430/543; 430/393; 430/428; 430/430; 430/510; 430/523; 430/566

[58] Field of Search ..... 430/393, 430, 431, 460, 430/461, 542, 543, 544, 564, 566, 428, 510, 523

[56] References Cited

U.S. PATENT DOCUMENTS

| | | | |
|---|---|---|---|
| 3,824,103 | 7/1974 | Pierce et al. | 430/611 |
| 4,144,068 | 3/1979 | Ishibashi et al. | 430/393 |
| 4,242,442 | 12/1980 | Idota et al. | 430/393 |
| 4,322,493 | 3/1982 | Shibaoka et al. | 430/461 |
| 4,328,302 | 5/1982 | Nishimura et al. | 430/611 |

*Primary Examiner*—J. Travis Brown

*Attorney, Agent, or Firm*—Sughrue, Mion, Zinn, Macpeak & Seas

[57] ABSTRACT

A color photographic silver halide light-sensitive material is described, containing at least one member of the compounds represented by the general formula (I-a) and (I-b) in at least one layer thereof:

Formula (I-a)

Formula (I-b)

(wherein all the symbols are defined in the appended claims). This color light-sensitive material can be subjected to rapid photographic processing; i.e., the compounds of the general formula (I-a) and (I-b) act as bleach accelerators, making it possible to perform rapid photographic processing without exerting adverse influences on photographic characteristics.

30 Claims, No Drawings

COLOR PHOTOGRAPHIC SILVER HALIDE LIGHT-SENSITIVE MATERIALS

FIELD OF THE INVENTION

The present invention relates to color photographic silver halide light-sensitive materials (hereinafter referred to as "color light-sensitive materials"). More particularly, the present invention relates to color light-sensitive materials which are suitable for rapid photographic processing, particularly for rapid bleaching or bleach-fixing treatment.

BACKGROUND OF THE INVENTION

In general, the photographic processing of color light-sensitive materials comprises basically a color developing step and a desilvering step. A color light-sensitive material which has been exposed imagewise is first sent to the color developing step where silver halide is reduced by a color developing agent, producing silver, while at the same time, the oxidized color developing agent reacts with a color former to provide a dye image. The color light-sensitive material is sent to the desilvering step where the silver produced at the preceding step is oxidized by an oxidizing agent (generally called a "bleaching agent") and, thereafter, removed by dissolving with a silver ioncomplexing agent generally called a "fixing agent". Finally, therefore, only the dye image is formed in the color light-sensitive material. However, the photographic processing actually includes auxiliary steps, e.g., for maintaining the photographic and physical characteristics of the image, or for improving the shelf life of the image, as well as the above-described two basic steps. Examples include a hardening bath for preventing excessive softening of light-sensitive layers during the photographic processing, a stop bath for effectively stopping the development reaction, an image-stabilizing bath for stabilizing the image, and a defilming bath for removing a backing layer form the support.

The desilvering treatment can be performed by a two-step process in which the bleaching and fixing baths are separated from each other, a one-step process in which there is used a bleach-fixing bath containing both a bleaching agent and a fixing agent; i.e., the treatment is more simplified for rapid processing and labor-saving.

In general, red prussiate and ferric chloride are good bleaching agents in that they have great oxidizing power. These compounds, however, cause various problems. For example, bleaching or bleach-fixing solutions containing red prussiate as a bleaching agent release cyanogen owing to photolysis, causing pollution problems. For this reason, their waste solutions should be made completely harmless by specific techniques. Also, bleaching solutions containing ferric chloride as a bleaching agent suffer from disadvantages in that because of their very low pH values and very great oxidizing power, they are liable to corrode parts of an apparatus to which they are charged. Furthermore, during the water-washing step after the bleaching treatment, ferric chloride causes iron hydroxide to precipitate in emulsion layers, producing stains.

Other bleaching agents which have heretofore been used include potassium dichromate, quinones, and copper salts. These compounds, however, have disadvantages in that they have only poor oxidizing power and are difficult to handle.

In recent years, in view of demands for a rapid and simplified photographic processing, and for preventing pollution, bleaching solutions composed mainly of iron (III) ion complex salts, e.g., aminopolycarboxylic acid iron (III) ion complex salts, in particular, an EDTA-iron (III) complex salt have been widely used.

These iron (III) ion complex salts, however, are of relatively low oxidizing power and possess insufficient bleaching power. When bleaching solutions containing such iron (III) ion complex salts as bleaching agents are used in the bleaching or bleach-fixing treatment of low sensitivity color light-sensitive materials prepared using mainly a silver chlorobromide emulsion, bleaching can be attained to a certain extent. However, in treating high sensitivity color light-sensitive materials which are prepared using mainly a silver chlorobromide or silver iodobromide emulsion, and are color sensitized, particularly camera color reversal light-sensitive materials and camera color negative light-sensitive materials in which emulsions containing a large amount of silver are used, their bleaching power is insufficient. This causes problems such as poor desilvering and the need for a long period of time for bleaching.

Bleaching agents other than the iron (III) ion complex salts such as persulfuric acid salts are known. These pursulfuric acid salts are usually used for preparing bleaching solutions in combination with chlorides. These bleaching solutions, however, have disadvantages in that their bleaching power is much lower than those of the iron (III) ion complex salts, and they need a long period of time for bleaching.

As described above, bleaching agents which are free from the problems of pollution and corrosion of processing equipment are not suitable for use in a rapid processing of color light-sensitive materials because of their poor bleaching power. It has therefore been desired to improve color light-sensitive materials so that they can be rapidly processed even with those bleaching agents having relatively low bleaching power.

A method has heretofore been employed in which bleach accelerators, e.g., amino compounds described in, for example, U.S. Pat. Nos. 3,772,020 and 3,809,563, are added to a processing bath (a bleaching or bleach-fixing bath, or its pre-bath). However, this method still takes a long period of time to achieve sufficient belaching. Moreover, many of the bleach accelerators are difficult to present in the bath in a stabilized condition, or emit an offensive odor. Thus, the addition of such compounds to the processing bath presents problems.

The addition of known bleach accelerators to color light-sensitive materials is also disclosed in, for example, Japanese Patent Application (OPI) No. 147529/78 (the term "OPI" as used herein means a "published unexamined Japanese patent application"). This method, however, suffers from disadvantages in that the known bleach accelerators have only a poor bleach-accelerating effect, and exert adverse influences on the photographic characteristics of color light-sensitive materials. Moreover, in accordance with this method, it is difficult to sufficiently bleach high silver content color light-sensitive materials including colloidal silver layers, such as a yellow filter layer and an antihalation layer while preventing an increase in fog due to colloidal silver during storage.

SUMMARY OF THE INVENTION

An object of the invention is to provide color light-sensitive materials which can be subjected to rapid photographic processing.

Another object of the invention is to provide color light-sensitive materials containing bleach accelerators which permit a rapid photographic processing, and do not exert adverse influences on the photographic characteristics of color light-sensitive materials.

A further object of the invention is to provide color light-sensitive materials including a colloidal silver layer which can be subjected to rapid photographic processing.

It has been found that the objects can be attained by incorporating at least one member of the compounds represented by the general formulae (I-a) and (I-b) as described hereinafter into at least one layer of the color light-sensitive materials.

DETAILED DESCRIPTION OF THE INVENTION

The compounds to be incorporated into at least one layer of color light-sensitive materials are represented by the following general formulae (I-a) and (I-b):

Formula (I-a)

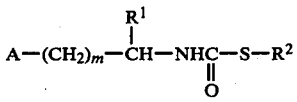

Formula (I-b)

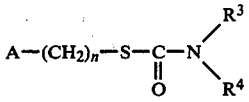

wherein A may be substituted and represents an amino group, or a nitrogen-containing heterocyclic radical; $R^1$ represents a hydrogen atom, or a carboxyl group; $R^2$ represents a monovalent metal atom (e.g., $Na^{\oplus}$, $Li^{\oplus}$, and $K^{\oplus}$), an ammonium group, an alkyl group which may be substituted, or a group represented by the formula:

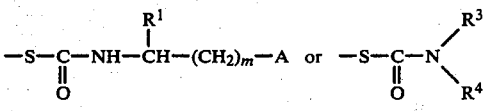

$R^3$ and $R^4$ each represents a hydrogen atom, or an alkyl group which may be substituted by a hydroxyl group, an alkoxyl group (e.g., a methoxy group, or an ethoxy group), a halogen atom, a carboxyl group, a group $—SO_2H$, a group $—SO_3H$, or the group A; m is 1 or 2; and n is an integer of from 2 to 4, preferably 2 or 3.

A preferred substituent for the amino group represented by A is an alkyl group containing from 1 to 3 carbon atoms. This alkyl group may be further substituted by a hydroxyl group, a methoxy group, or an ethoxy group, The amino group represented by A may be substituted by one or two alkyl groups.

The nitrogen-containing heteroxyclic radical represented by A is a nitrogen-containing 5- or 6-membered heterocyclic radical. Preferred examples include saturated heterocyclic radicals, e.g., pyrrolidine, piperidine, piperazine, and morpholine radicals, and unsaturated heterocyclic radicals, e.g., imidazole, triazole, and indole radicals. These heterocyclic radicals may be substituted by an alkyl group containing from 1 to 3 carbon atoms which may be further substituted by a hydroxyl group, a methoxy group, or an ethoxy group.

The alkyl group represented by $R^2$, $R^3$, and $R^4$ preferably contains from 1 to 5 carbon atoms. Suitable examples include a methyl group, an ethyl group, and a propyl group. This alkyl group may be substituted by, for example, halogen, hydroxyl group, alkoxy group, carboxyl group, $—SO_3H$, or $—SO_2H$. Examples of these substituted alkyl groups include $—CH_2Cl$, $—CH_2CH_2OH$, $—CH_2CH_2OCH_3$, $—CH_2CH_2OC_2H_5$, $—CH_2CH(OH)CH_3$, $—CH_2COOH$, $—CH_2CH_2COOH$, $—CH_2CH_2CH_2COOH$, $—CH_2SO_3H$, $—CH_2CH_2SO_3H$, $—CH_2CH_2CH_2SO_3H$, $—(CH_2)_4SO_3H$, $—CH_2SO_2H$, $—CH_2CH_2SO_2H$, $—(CH_2)_3SO_2H$, and $—(CH_2)_4SO_2H$, and, furthermore, $—CH_2CH_2—A$, $—C(CH_2)_3—A$, $—CH_2SCONHCH(R^1)(CH_2)_m—A$, $—CH_2CH(OH)CH_2SCONHCH(R^1)(CH_2)_m—A$, and $—(CH_2)_2SO_2(CH_2)_2—SCONHCH(R^1)(CH_2)_m—A$.

Suitable examples of the compounds represented by the general formulae (I-a) and (I-b) are shown below:

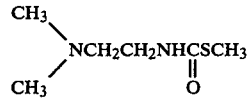

(I-a)-(1)

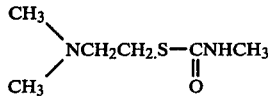

(I-b)-(2)

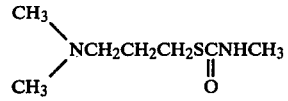

(I-b)-(3)

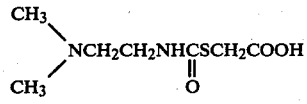

(I-a)-(4)

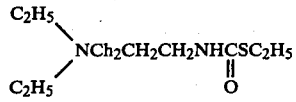

(I-a)-(5)

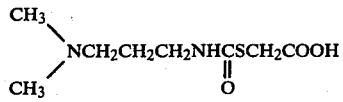

(I-a)-(6)

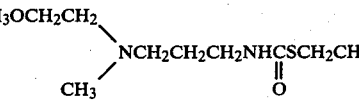

(I-a)-(7)

(I-a)-(8)

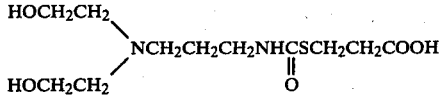

(I-a)-(9)

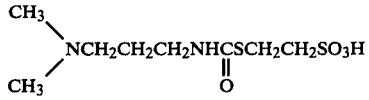

(I-a)-(10)

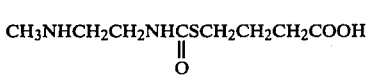

-continued
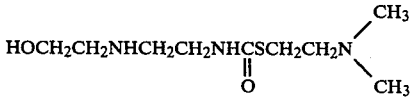
(I-a)-(11)
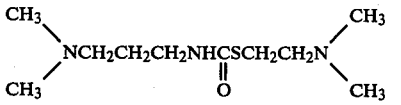
(I-a)-(12)
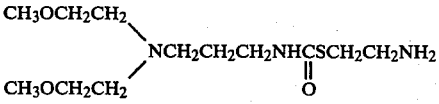
(I-a)-(13)
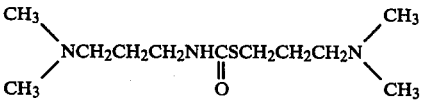
(I-a)-(14)
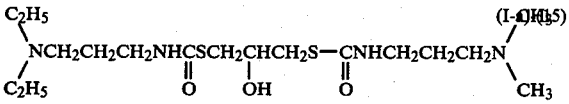
(I-a)-(15)
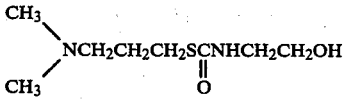
(I-b)-(16)
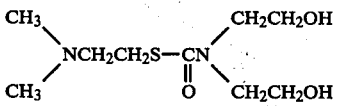
(I-b)-(17)
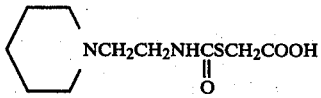
(I-a)-(18)
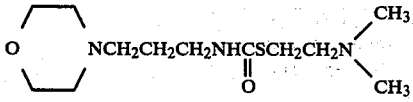
(I-a)-(19)
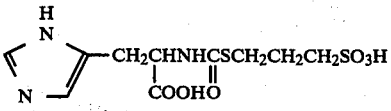
(I-a)-(20)
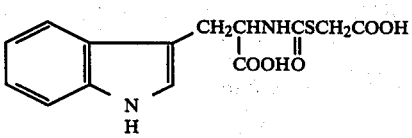
(I-a)-(21)
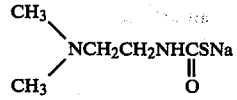
(I-a)-(22)
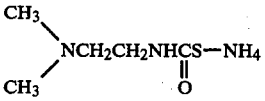
(I-a)-(23)
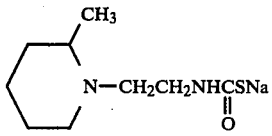
(I-a)-(24)
-continued
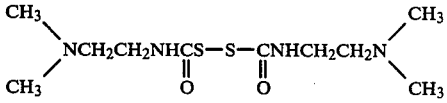
(I-a)-(25)
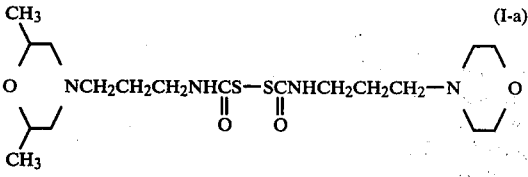
(I-a)-(26)
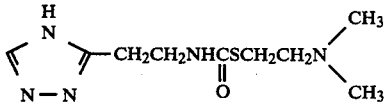
(I-a)-(27)
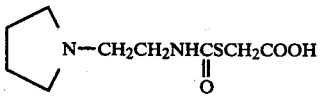
(I-a)-(28)
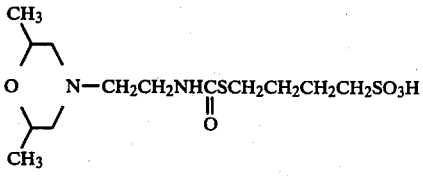
(I-a)-(29)
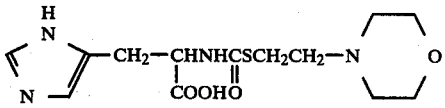
(I-a)-(30)
The compounds of the general formulae (I-a) and (I-b) can be synthesized, for example, by the following processes:
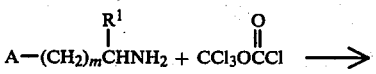
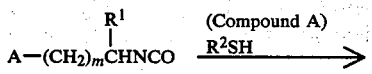
(Compound B)
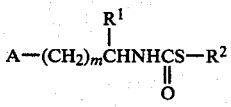
(Compound of General formula (I-a))
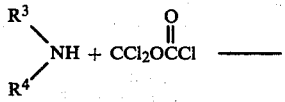

-continued

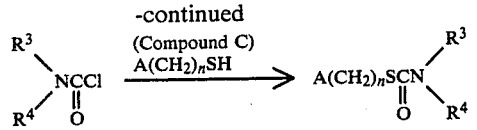

(Compound D) (Compound of General Formul (I-b)).

(The symbols A, $R^1$, $R^2$, $R^3$, $R^4$, m, and n are the same as defined in the general formulae (I-a) and (I-b).)

The compound of the general formula (I-a) can be prepared as follows:

A solution of Compound A (amino compound) in, for example, dichloromethane or tetrahydrofuran (THF), and a phosgene dimer (TCF) are first reacted to form Compound B (isocyanate compound). Then, Compound B is reacted with alkylmercaptan $R^2SH$ to prepare the desired compound.

The compound of the general formula (I-b) can be prepared as follows:

Compound C (amino compound) and TCF are first reacted to form Compound D(carbamoyl chloride). Then, Compound D is reacted with aminoalkylmercaptan or nitrogen-containing heterocyclic radical substituted alkylmercaptan $A—(CH_2)_nSH$ to prepare the desired compound.

The compound of the general formula (I-a) or (I-b) is added to at least one layer constituting color light-sensitive materials. The amount of the compound added is not critical. In general, it is preferably within the range of from $1\times10^{-7}$ to $1\times10^{-3}$ mole per square meter (mole/m$^2$) and more preferably within the range of from $1\times10^{-6}$ to $1\times10^{-4}$ mole/m$^2$. Compounds of the general formula (I-a) or (I-b) can be used alone or in combination with each other.

Color light-sensitive materials as used herein may take various layer structures depending on the use thereof because they have many uses (for example, are used as color positive, color paper, color negative, or color reversal materials (containing or not containing couplers), in particular, as high silver color light-sensitive materials having a total silver amount of at least 30 mg/100 cm$^2$, particularly at least 40 mg/100 cm$^2$). The effects of the invention can be fully obtained when the color light-sensitive material takes a layer structure comprising a support, and an antihalation layer, (an intermediate layer), a red-sensitive emulsion layer, (an intermediate layer), a green-sensitive emulsion layer, a yellow filter layer, a blue-sensitive emulsion layer, and a protective layer coated on the support in order, one or both of the antihalation and yellow filter layers containing colloidal silver. The intermediate layers in the parentheses may be omitted. Each of the red-sensitive, green-sensitive, and blue-sensitive layers may be divided into low-sensitive and high-sensitive layers. In addition, a layer structure in which at least one of red-sensitive, green-sensitive, and blue-sensitive layers is divided into three layers (see Japanese Patent Publication No. 15495/74), a layer structure in which a high sensitivity emulsion layer unit and a low sensitivity emulsion layer unit are separated (see Japanese Patent Application (OPI) No. 49027/76), and the layer structures described in West German Patent Laid-Open Nos. 2,622,922, 2,622,923, 2,622,924, 2,704,826 and 2,704,797 can be employed.

The compound of the general formula (I-a) or (I-b) is preferably added to a protective layer, a subbing layer, an intermediate layer, a silver halide emulsion layer, a yellow filter layer, an antihalation layer, etc. Of these layers, those layers containing colloidal silver are preferred for the incorporation of the compound of the invention. In particular, the addition of the compound to the colloidal silver antihalation layer that is usually most difficult to bleach is advantageous in that the bleaching efficiency of the antihalation layer is greatly increased.

In a preferred embodiment of the invention, the compounds of the invention, represented by the general formulae (I-a) and/or (I-b) are used in combination with the compounds of the general formula (II) as described hereinafter in order to allow the bleaching using persulfuric acid salts to proceed more efficiently. The compounds of the general formula (II) have the function of inhibiting changes with time in the photographic characteristics of color light-sensitive materials, in particular, an increase in fog due to colloidal silver. Other stabilizers or antifoggants having a similar function are often adsorbed by silver strongly, inhibiting desilvering, whereas the compounds of the general formula (II) do not inhibit desilvering. Therefore, the compounds of the general formula (II) are very advantageous for use in combination with the compounds of the general formulae (I-a) and/or (I-b):

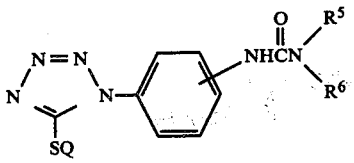

Formula (II)

wherein Q is a hydrogen atom, an alkali metal atom, or a quaternary ammonium group; and $R^5$ and $R^6$ are each a hydrogen atom, an unsubstituted or substituted aliphatic group, or an unsubstituted or substituted aromatic group, and $R^5$ and $R^6$ may be the same or different and may combine together to form a ring.

Alkali metal atoms represented by Q include $Li^{\oplus}$, $Na^{\oplus}$ and $K^{\oplus}$.

Quaternary ammonium groups include $H_4N^{\oplus}$, $(CH_3)_4N^{\oplus}$, $(C_4H_9)_4N^{\oplus}$, $n—C_{12}H_{25}(CH_3)_3N^{\oplus}$, $n—C_{16}H_{33}(CH_3)_3N^{\oplus}$, and $Ph—CH_2(CH_3)_3N^{\oplus}$.

Aliphatic groups reprsented by $R^5$ and $R^6$ are preferably alkyl and alkenyl groups containing up to 18 carbon atoms. Examples include a methyl group, an ethyl group, an n-propyl group, an n-butyl group, a tert-butyl group, an n-pentyl group, an n-hexyl group, a cyclohexyl group, an n-octyl group, an n-dodecyl group, an n-octadecyl group, and an allyl group.

A preferred example of the aromatic groups represented by $R^5$ and $R^6$ is an aryl group containing from 6 to 20 carbon atoms. Examples are a phenyl group and a naphthyl group.

The ring formed by $R^5$ and $R^6$ contains from 2 to 10 carbon atoms, and may contain therein O, N, or S. Examples are $\leftarrow CH_2 \rightarrow_4$, $\leftarrow CH_2 \rightarrow_5$, $\leftarrow CH_2 \rightarrow_6$, $—CH_2CH_2OCH_2CH_2—$, and $—CH_2CH_2N(CH_3)CH_2CH_2—$.

Substituents of the substituted aliphatic and aromatic groups represented by $R^5$ and $R^6$ include an alkoxy group (e.g., a methoxy group, and an ethoxy group), halogen (e.g., chroline and bromine), an alkyl group (e.g., a methyl group, and an ethyl group), a phenyl group, an alkoxycarbonyl group (e.g., an ethoxycarbonyl group), an acyl group (e.g., an acetyl group), an acyloxy group (e.g., an acetyloxy group), a cyano group, a nitro group, an alkylthio group (e.g., a methylthio group), an amido group (e.g., an acetamido group), and a sulfonamido group (e.g., a methanesulfonamido group).

Particularly preferred examples of $R^5$ and $R^6$ are an alkyl group containing from 1 to 6 carbon atoms, and a phenyl group. More preferred are a methyl group, an ethyl group, an n-propyl group, an n-butyl group, and an n-pentyl group.

Suitable examples of the compounds of the general formula (II) are shown below although the invention is not limited thereto.

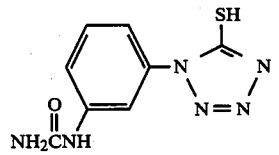

(II)-(1)

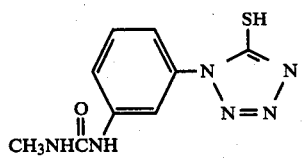

(II)-(2)

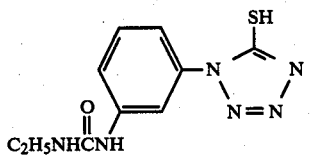

(II)-(3)

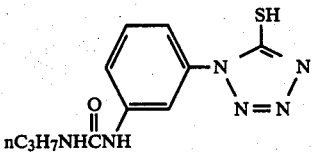

(II)-(4)

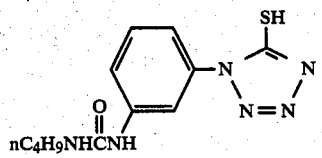

(II)-(5)

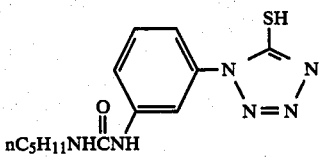

(II)-(6)

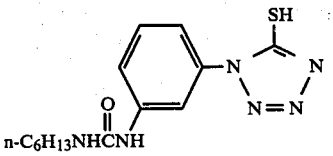

(II)-(7)

-continued

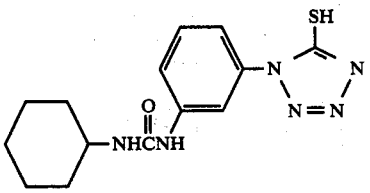

(II)-(8)

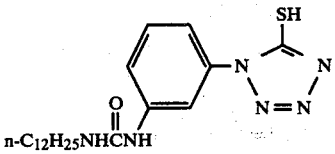

(II)-(9)

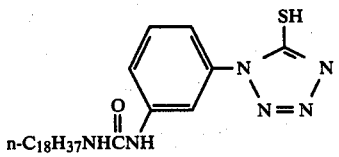

(II)-(10)

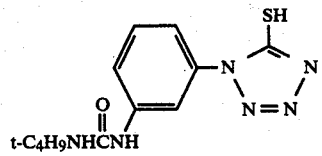

(II)-(11)

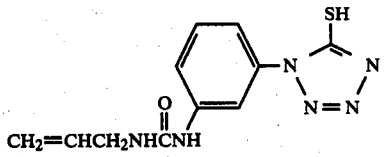

(II)-(12)

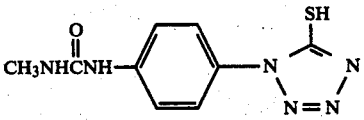

(II)-(13)

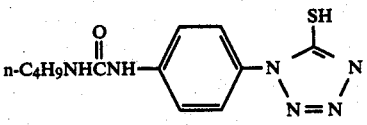

(II)-(14)

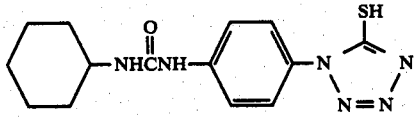

(II)-(15)

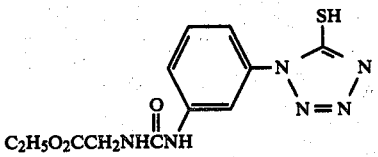

(II)-(16)

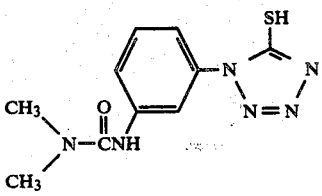

(II)-(17)

-continued (II)-(18)

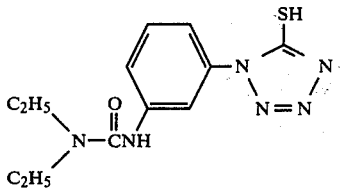

(II)-(19)

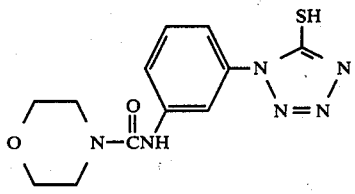

(II)-(20)

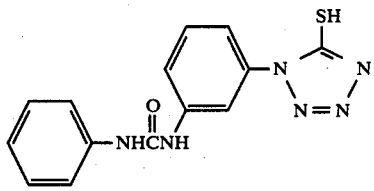

(II)-(21)

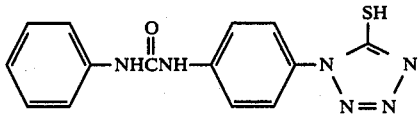

(II)-(22)

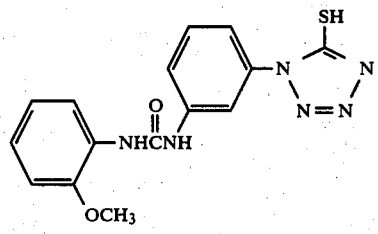

(II)-(23)

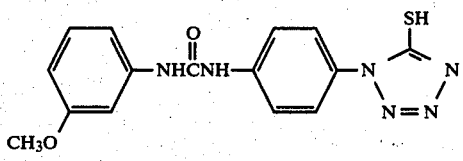

(II)-(24)

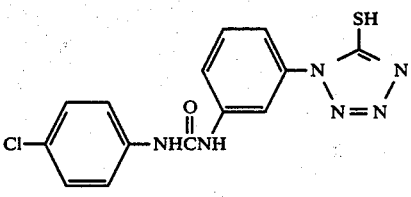

(II)-(25)

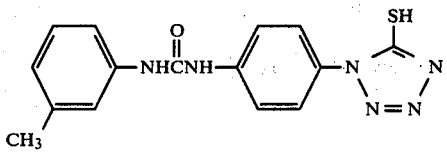

-continued (II)-(26)

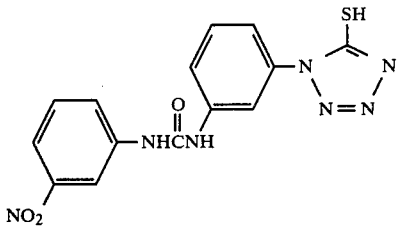

(II)-(27)

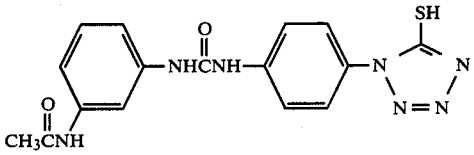

(II)-(28)

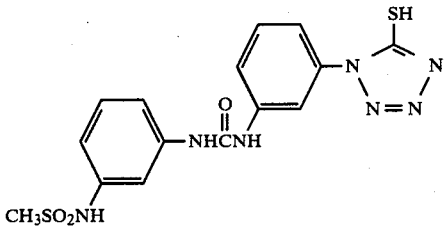

(II)-(29)

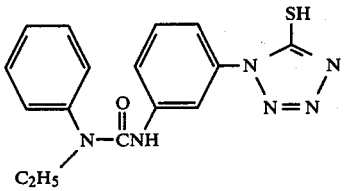

(II)-(30)

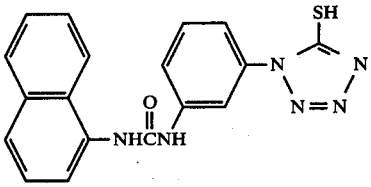

(II)-(31)

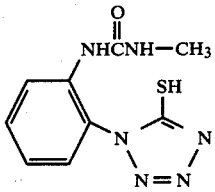

(II)-(32)

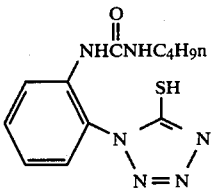

These compounds can be synthesized by hydrolyzing the amido group of amido-substituted 1-phenyl-5-mercaptotetrazole as described in Japanese Patent Application (OPI) Nos. 37436/75 and 3231/76 and U.S. Pat. Nos. 3,295,976 and 3,376,310 with a strong acid, e.g., hydrochloric acid, to form amino-substituted 1-phenyl-5-mercaptotetrazole, and thereafter, reacting the amino-substituted 1-phenyl-5-mercaptotetrazole with suitable isocyanic acid esters or N,N-disubstituted carbamoylchloride.

Suitable preparation methods will hereinafter be explained.

(1) Synthesis of Compound (II)-(5)

In 450 ml of ethanol was dispersed 150 g (0.51 mol) of 1-(3-hexaneamidophenyl)-5-mercaptotetrazole, and 300 ml of concentrated hydrochloric acid was added to the resulting dispersion while stirring at room temperature. They were further reacted at room temperature for 3 hours and, thereafter, cooled with ice. The thus-precipitated crystals were filtered off and washed with acetone to obtain 110 g of a 1-(3-aminophenyl)-5-mercaptotetrazole hydrochloric acid salt. This amine hydrochloric acid salt was dispersed in 750 ml of acetonitrile, and 485 ml of triethylamine was added thereto. Thereafter, 125 g of butyl isocyanate was added dropwise at room temperature. They were further reacted at room temperature for 6 hours. At the end of the time, 2,200 ml of water was added, and the pH of the resulting solution was adjusted to 2 with hydrochloric acid. The thus-precipitated crystals were filtered off, and recrystallized from ethanol to obtain 69 g (yield, 46%) of the desired compound, m.p. 171°-172° C. (decomposition).

(2) Synthesis of Compound (II)-(18)

In 220 ml of acetonitrile were dispersed 23 g of 1-(3-aminophenyl)-5-mercaptotetrazole and 32 g of pyridine, and 16 g of N,N-diethylcarbamoylchloride was added dropwise to the resulting dispersion. The mixture was then refluxed for 1.5 hours. At the end of the time, 200 ml of water was added, and the resulting mixture was extracted with ethyl acetate. The thus-obtained extract was recrystallized from 250 ml of acetonitrile to obtain 15 g (yield, 51%) of the desired compound, m.p. 184°-185° C. (decomposition).

The other compounds can be synthesized in the same manner as above.

The amount of the compound of the general formula (II) being added varies depending on the type of the compound and the layer to which the compound is to be added and, therefore, cannot be determined unconditionally. It has been found that the use of the compound within the range of from $10^{-2}$ to $10^{2}$ moles per mole of silver enables to inhibit changes with time in the photographic characteristics of the resulting color light-sensitive material during the storage thereof, in particular, the formation of fog. More preferably, the compound is added in an amount ranging between $10^{-1}$ and 10 moles per mole of silver.

The compound of the general formula (II) and the compound of the general formula (I-a) or (I-b) may be added to the same layer or different layers. Since the compound of the general formula (II) is effective for preventing an increase with time in fog of an adjacent layer which is caused by colloidal silver diffused into the adjacent layer and acting as a physical developing nucleus, it is advantageous to add the compound to a layer containing colloidal silver (e.g., a yellow filter layer or an antihalation layer).

As silver halide for use in the photographic emulsion layers of color light-sensitive materials as used herein, any silver bromide, silver iodobromide, silver iodochlorobromide, silver chlorobromide, and silver chloride can be used. Although the mean grain size of silver halide particles in the photographic emulsions is not critical, it is preferably 3μ or less. The term "grain size" is used herein to refer to the diameter of a particle when it is spherical or similar to a sphere in the shape, or the edge length when it is cubic, and the mean grain size is determined on the basis of the projected areas. The grain size distribution may be narrow or broad.

Silver halide particles in the photographic emulsions may have regular crystal forms, e.g., cubic and octagonal crystal forms, or irregular crystal forms, e.g., spherical and plate-like crystal forms, or their composite crystal forms. A mixture of particles having various crystal forms may be used.

Silver halide particles may have a homogeneous phase or a heterogeneous phase in which the inner portion and the surface layer are different. Those particles in which a latent image is formed mainly on the surface, or those particles in which a latent image is formed mainly in the inner portion thereof may be used.

Photographic emulsions as used herein can be prepared by the methods described in, for example, P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964); that is, they can be prepared in any suitable manner, e.g., by an acidic process, a neutral process, and an ammonia process. Also, soluble silver salts and soluble halides can be reacted in any suitable manner, e.g., a one-side mixing process, a simultaneous mixing process, and a combination thereof.

A method of forming particles in the presence of an excess of silver ions (a so-called reversal mixing process) can be used. As one type of simultaneous mixing process, a method in which the pAg in a liquid phase were silver halide is formed is maintained at a constant level (a so-called controlled double jet process) can be employed. In accordance with this method, silver halide emulsions can be obtained in which silver halide particles have a regular crystal form and a nearly uniform grain size.

A mixture of two or more silver halide emulsions which are prepared separately may be used.

The formation or physical aging of silver halide particles may be performed in the presence of cadmium salts, zinc salts, lead salts, thallium salts, iridium salts or its complex salts, rhodium salts or its complex salts, iron salts or its complex salts, and the like.

Negative type emulsions forming a surface latent image or direct reversal type emulsions can be used. The latter emulsions include an internal latent image type emulsion and a previously fogged direct reversal type emulsion.

Internal latent image type silver halide emulsions which can be advantageously used in the invention include conversion type emulsions, core/shell type emulsions, and different metal-containing emulsions. These emulsions are described in, for example, U.S. Pat. Nos. 2,592,250, 3,206,313, 3,447,927, 3,761,276 and 3,935,014.

Nucleus-forming agents which can be used in emulsions of these internal latent image type include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/74 and U.S. Pat. Nos. 3,734,738, 3,719,494 and 3,615,615; sensitizing dyes containing therein a necleating substituent described in U.S. Pat.

No. 3,718,470; and acylhydrazinophenylthiourea compounds described in U.S. Pat. Nos. 4,030,925 and 4,031,127.

Silver halide emulsions are usually subjected to chemical sensitization although they can be used as so-called primitive emulsions without application of chemical sensitization. This chemical sensitization can be performed by the methods described in the above-described references by P. Glafkides, and V. L. Zelikman et al., and H. Frieser ed., *Die Grundlagen der Photographischen Prozesse mit Silberhalogeniden,* Akademische Verlagsgesellschaft (1968).

In more detail, for the chemical sensitization, a sulfur sensitization process using compounds containing sulfur capable of reacting with silver ions, or activated gelation, a reduction sentization process using reducing substances, a noble metal sensitization process using noble metal compounds, e.g., gold compounds, and so forth can be used alone or in combination with each other. Sulfur sensitizing agents which can be used include thiosulfuric acid salts, thioureas, thiazoles, and rhodanines. Their typical examples are described in U.S. Pat. Nos. 1,574,944, 2,410,689, 2,278,947, 2,728,668 and 3,656,955. Reduction sensitizing agents which can be used include stannous salts, amines, hydrazine derivatives, formamizinesulfuric acid, and silane compounds. Their typical examples are described in U.S. Pat. Nos. 2,487,850, 2,419,974, 2,518,698, 2,983,609, 2,983,610 and 2,694,637. For nobel metal sensitization, complex salts of Group VIII metals, e.g., platinum, iridium, and palladium, as well as gold complex salts can be used. Their typical examples are described in U.S. Pat. Nos. 2,399,083, and 2,448,060 and British Pat. No. 618,061.

Photographic emulsions may be subjected to spectral sensitization using, for example, methine dyes. Dyes which can be used for this spectral sensitization include cyanine dye, merocyanine dye, composite cyanine dye, composite merocyanine dye, holopolar cyanine dye, hemicyanine dye, styryl dye, and hemioxonol dye. Particularly useful dyes are cyanine dye, merocyanine dye, and composite merocyanine dye.

Useful sensitizing dyes are described in, for example, German Pat. No. 929,080, U.S. Pat. Nos. 2,231,658, 2,493,748, 2,503,776, 2,519,001, 2,912,329, 3,655,394, 3,656,959, 3,672,897 and 3,694,217, British Pat. No. 1,242,588, and Japenese Patent Publication No. 14030/69.

In addition to the layers of light-sensitive silver halide emulsions as described above, those layers made of finely divided silver halide emulsions which are substantially insensitive may be provided for various purposes, e.g., for improving granuality and sharpness. These substantially insensitive finely divided silver halide emulsion layers may be provided on the light-sensitive silver halide emulsion layer, or between the light-sensitive silver halide emulsion layer and the colloidal silver layer (e.g., a yellow filter layer, or an antihalation layer).

For the purpose of increasing sensitivity and contrast, or accelerating development, polyalkyleneoxide or its ether, ester, amine, or like derivatives, thioether compounds, thiomorpholines, quaternary ammonium salt compounds, urethane derivatives, urea derivatives, imidazole derivatives, 3-pyrazolidones, etc. may be incorporated in the color light-sensitive material of the invention. Compounds which can be used are described in, for example, U.S. Pat. Nos. 2,400,532, 2,423,549, 2,716,062, 3,617,280, 3,772,021 and 3,808,003.

As a binder for use in the photographic emulsion layers and other layers, it is advantageous to use gelatin. In addition, other hydrophilic colloids can be used, including proteins, such as gelatin derivatives, graft polymers of gelatin and other polymers, albumin, and casein; sugar derivatives, such as cellulose derivatives, e.g., hydroxyethyl cellulose, carboxymethyl cellulose, and cellulose sulfates, sodium alginate, and starch derivatives; and hydrophilic synthetic homopolymers or copolymers, such as polyvinyl alohol, polyvinyl alcohol partial acetal, poly-N-vinyl pyrrolidone, polyacrylic acid, polymethacrylic acid, polyacrylamide, polyvinyl imidazole, and polyvinyl pyrazole.

Useful gelatins include lime-treated gelatin, acid-treated gelatin and enzyme-treated gelatin as described in *Bull. Soc. Sci. Phot., Japan,* No. 16 page 30 (1966). Furthermore, hydrolyzates and enzyme decomposition products of gelatin can be used. Gelatin derivatives are prepared by reacting gelatin with various compounds, such as acid halides, acid anhydrides, isocyanates, bromoacetic acid, alkanesultones, vinylsulfonamides, maleinimido compounds, polyalkylene oxides, and epoxy compounds. Typical examples are described in, for example, U.S. Pat. Nos. 2,614,928, 3,132,945, 3,186,846 and 3,312,553, British Pat. Nos. 861,414, 1,033,189 and 1,005,784 and Japanese Patent Publication No. 26845/67.

The above-described gelatin graft polymers are prepared by grafting homo- or co-polymers of acrylic acid, methacrylic acid, or their ester, amido, or like derivatives, and vinyl monomers, such as acrylonitrile and styrene, onto gelatin. In particular, graft polymers of gelatin and polymers having some compatibility with gelatin, such as polymers of acrylic acid, methacrylic acid, acrylamide, methacrylamide, and hydroxyalkyl methacrylate, are preferred. Examples are described in, for example, U.S. Pat. Nos. 2,763,625, 2,831,767 and 2,956,884.

Typical hydrophilic synthetic polymers are described in, for example, West German Patent Application (OLS) No. 2,312,708, U.S. Pat. Nos. 3,620,751 and 3,879,205 and Japanese Patent Publication No. 7561/68.

The color light-sensitive material of the invention may contain various compounds as antifoggants or stabilizers in combination with the compounds of the general formula (II). That is, a number of compounds known as antifoggants or stabilizers can be added, including azoles, such as benzothiazolium salts, nitroindazoles, triazoles, benzotriazoles, and benzimidazoles (particularly, nitro or halogen-substituted compounds); heterocyclic mercapto compounds, such as mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines, and their derivatives containing water-soluble groups, such as a carboxyl group, and a sulfonic acid group; thioketo compounds, such as oxazolinthione; azaindenes, such as tetraazaindenes (particularly, 4-hydroxy-substituted (1,3,3*a*,7)tetraazaindenes); benzenethiosulfonic acids; and benzenesulfinic acids.

In connection with suitable examples of the above-described compounds, and methods of using them, U.S. Pat. Nos. 3,954,474, 3,982,947 and 4,021,248 and Japanese Patent Publication No. 28660/77, etc. can be referred to.

In the color-sensitive material of the invention, the photographic emulsion layers and other constitutive layers may contain inorganic or organic hardening agents. Hardening agents which can be used include chromium salts (e.g., chromium alum, and chromium acetate), aldehydes (e.g., formaldehyde, glyoxal, and glutaraldehyde), N-methylol compounds (e.g., dimethylolurea, and methyloldimethylhydantoin), dioxane derivatives (e.g., 2,3-dihydroxydioxane), active vinyl compounds (e.g., 1,3,5-triacryloyl-hexahydro-S-triazine, and 1,3-vinylsulfonyl-2-propanol), active halogen compounds (e.g., 2,4-dichloro-6-hydroxy-S-triazine), and mucohalogenic acids (e.g., mucochloric acid, and mucophenoxychloric acid). These compounds can be used alone or in combination with each other.

In addition, the photographic emulsion layers and other constitutive layers may contain various surfactants for various purposes, e.g., as coating aids or antistatic agents, of for improving sliding properties, accelerating emulsification and dispersion, preventing adhesion, or improving photographic characteristics (e.g., acceleration of development, increasing contrast, and sensitization).

Surfactants which can be used include nonionic surfactants, such as saponin (steroid type), alkyleneoxide derivatives (e.g., polyethylene glycol, a condensate of polyethylene glycol and polypropylene glycol, polyethylene glycol alkyl ethers or polyethylene glycol alkylaryl ethers, polyethylene glycolesters, polyethylene glycol sorbitan esters, polyalkylene glycol alkylamines or amides, and polyethyleneoxide adducts of silicone), glycidol derivatives (e.g., alkenylsuccinic acid polyglyceride, and alkylphenol polyglyceride), aliphatic acid esters of polyhydric alcohols, and alkyl esters of saccharides; anionic surfactants containing acidic groups, such as a carboxyl group, a sulfo group, a phospho group, a sulfuric acid ester group, and a phosphoric acid ester group, e.g., alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltauric acid, sulfosuccinic acid esters, sulfoalkylpolyoxyethylene alkylphenyl ethers, and polyoxyethylene alkylphosphoric acid esters; amphoteric surfactants, such as aminoacids, aminoalkylsulfonic acids, aminoalkylsulfuric acid or phosphoric acid esters, alkylbetaines, and amineoxides; and cationic surfactants, such as alkylamine salts, aliphatic or aromatic quaternary ammonium salts, heterocyclic quaternary ammonium salts, e.g., pyridinium and imidazolium, and aliphatic or heterocyclic ring-containing phosphonium or sulfonium salts.

Color-forming couplers, i.e., compounds capable of forming color on oxidative coupling with aromatic primary amine developers (e.g., phenylenediamine derivatives, and aminophenol derivatives) at the color developing step, which are used in the photographic emulsion layers of the light-sensitive material of the invention include magenta couplers, such as a 5-pyrazolone coupler, a pyrazolobenzimidazole coupler, a cyanoacetylcumarone coupler, and a closed-chain acylacetonitrile coupler; yellow couplers, such as an acylacetoamide coupler (e.g., benzoylacetoanilides, and pivaloylacetoanilides); and cyan couplers, such as a naphthol coupler, and a phenol coupler. Non-diffusing couplers containing therein a hydrophobic group called a ballast group are preferred. These couplers may be four-equivalent or two-equivalent in relation to silver ions. In addition, colored couplers having the color correction effect, or couplers (so-called DIR couplers) releasing a development inhibitor with the advance of development can be used. Other than the DIR couplers, colorless DIR coupling compounds or DIR redox compounds which produce a colorless coupling reaction product, and release a developing inhibitor may be incorporated.

Suitable examples of magenta color-forming couplers are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945, 2,418,959, and 2,424,467, Japanese Patent Publication No. 6031/65 and Japanese Patent Application (OPI) Nos. 20826/76, 13041/75, 58922/77, 129538/74, 74027/74, 159336/75, 42121/77, 74028/74, 60233/75, 26541/76 and 55122/78.

Suitable examples of yellow color-forming couplers are described in, for example, U.S. Pat. Nos. 2,875,057, 3,265,506, 3,408,194, 3,551,155, 3,582,322, 3,725,072 and 3,891,445, West German Pat. No. 1,547,868, West German Patent Application Laid-Open Nos. 2,219,917, 2,261,361, and 2,414,006, British Pat. No. 1,425,020, Japanese Patent Publication No. 10783/76, and Japanese Patent Application (OPI) Nos. 26133/72, 73147/73, 102636/76, 6341/75, 123342/75, 130442/75, 21827/76, 87650/75, 82424/77, and 115219/77.

Suitable examples of cyan couplers are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, and 4,004,929, West German Patent Application (OLS) Nos. 2,414,830, and 2,454,329, and Japanese Patent Application (OPI) Nos. 59838/73, 26034/76, 5055/73, 146828/76, 69624/77 and 90932/77.

Colored couplers which can be used are described in, for example, U.S. Pat. Nos. 3,476,560, 2,521,908, and 3,034,892, Japanese Patent Publication Nos. 2016/79, 22335/63, 11304/67, and 32461/69, Japanesse Patent Application (OPI) Nos. 26034/76 and 42121/77, and West German Patent Application (OLS) No. 2,418.959.

DIR couplers include o-aminoazo type DIR couplers described in U.S. Pat. No. 3,148,062, thioether type DIR couplers described in U.S. Pat. No. 3,227,554, 2-benzotriazolyl type DIR couplers described in U.S. Pat. No. 3,617,291, 1-benzotriazolyl type DIR couplers described in West German Patent Application (OLS) No. 2,414,006, Japanese Patent Application (OPI) Nos. 82424/77 and 117627/77, nitrogen-containing heterocyclic ring-substituted acetic acid ester type DIR couplers described in Japanese Patent Application (OPI) Nos. 30591/75 and 82423/77, two-equivalent type DIR cyan couplers described in West German Patent Application (OLS) No. 2,527,652, and Japanese Patent Application (OPI) Nos. 90932/77 and 146828/76, and malonic acid diamide type DIR couplers described in Japanese Patent Application (OPI) No. 69624/77.

Colorless DIR coupling compounds include thioether type cyclic colorless DIR compounds described in British Pat. No. 1,423,588, West German Patent Application (OLS) Nos. 2,405,442, 2,523,705, 2,529,350, and 2,448,063, and U.S. Pat. No. 3,938,996, thioether type chain-like colorless DIR compounds described in U.S. Pat. Nos. 3,632,345 and 3,938,041, benzotriazolyl type colorless DIR compounds described in Japanese Patent Application (OPI) Nos. 147716/75, 105819/76, and 67628/77, and picolinium type DIR coupling compounds described in Japanese Patent Application (OPI) No. 72433/76.

DIR redox compounds include DIR hydroquinones described in U.S. Pat. No. 3,639,417, West German Patent Application (OLS) No. 2,460,202, and U.S. Pat. No. 3,297,445, and DIR redox type couplers described in Japanese Patent Application (OPI) No. 57828/77.

The color light-sensitive material of the invention may contain developing agents. Those developing agents as described in *Research Disclosure,* Vol. 176, page 29, "Developing Agents" can be used.

The color light-sensitive material of the invention may contain dyes in its photographic emulsion layers and other layers as filter dyes or for the purpose of, e.g., preventing irradiation. As these dyes, the compounds described in *Research Disclosure,* Vol. 176, pp. 25–26, "Absorbing and Filter Dyes" can be used.

The color light-sensitive material of the invention may further contain antistatic agents, plasticizers, matting agents, lubricants, ultraviolet ray-absorbing agents, fluorescent whiteners, agents for preventing air fogging, and the like.

Silver halide emulsion layers and/or other layers are coated on a support by suitable techniques, e.g.., the methods described in *Research Disclosure,* Vol. 176, pp. 27–28, "Coating Procedure".

When the color light-sensitive material of the invention is used as a color negative film, a color positive film, or a color paper, it is exposed imagewise and, thereafter, is subjected to a photographic processing which usually comprises basically the following steps:

(1) color development—bleaching (using ethylenediamine tetraacetic acid iron (III) complex salts)—water-washing—fixing—water-washing—stabilization—drying; or (2) color development—stopping—water-washing (bleach acceleration bath)—bleaching (using persulfuric acid salts)—water-washing—fixing—water-washing—stabilization—drying.

In the process (2), a pre-bath, a hardening bath, etc. may be provided before the color development, or the water-washing steps after the stopping bath, the bleach acceleration bath, and the bleaching step using persulfuric acid salts may be omitted. Also, the bleach acceleration bath may be omitted.

When the color light-sensitive material of the invention is used as a color reversal film, it is usually subjected to a photographic processing comprising basically the following steps:

(3) black and white development—stopping—water-washing—fogging—water-washing—color development—stopping—water-washing—(bleach acceleration bath)—water-washing—bleaching (using persulfuric acid salts)—water-washing—fixing—water-washing—stabilization—drying.

In process (3), a pre-bath, a pre-hardening bath, a neutralizing bath, etc. may be provided. The water-washing steps after the stopping step, the fogging step, the bleach acceleration bath, and the bleaching step may be omitted. Re-exposure may be substituted for the fogging bath, or the fogging bath may be omitted by adding a fogging agent to the color developing bath. Moreover, the bleach acceleration bath may be omitted.

The basic processing steps used in processing the color light-sensitive material of the invention which is used as a color paper generally include:

(4) color development—bleach-fixing—water-washing—drying.

Color developers as used herein are generally composed of alkaline aqueous solutions containing color developing agents. As these color developing agents, known primary aromatic amine developing agents, e.g., phenylenediamines, such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, and 4-amino-3-methyl-N-ethyl-N-β-methoxyethylaniline, can be used. In addition, the compounds described in, for example, F. A. Mason, *Photographic Processing Chemistry,* the Focal Press, pp. 226–229 (1966), U.S. Pat. Nos. 2,193,015 and 2,592,364, and Japanese Patent Application (OPI) No. 64933/73 can be used.

These color developers may further contain pH buffers, e.g., the sulfurous acid, carbonic acid, boric acid, and phosphoric acid salts of alkali metals, development inhibitors or antifoggants, e.g., bromides, iodides, and organic antifoggants, and the like. In addition, if necessary, they may contain hard water-softening agents, preservatives, e.g., hydroxylamine, organic solvents, e.g., benzyl alcohol and diethylene glycol, development accelerators, e.g., polyethylene glycol, quaternary ammonium salts, and amines, dye-forming couplers, competing couplers, fogging agents, e.g., sodium borohydride, auxiliary developing agents, e.g., 1-phenyl-3-pyrazolidone, tackifiers, polycarboxylic acid-based chelating agents described in U.S. Pat. No. 4,083,723, antioxidants described in West German Patent application (OLS) No. 2,622,950, and the like.

In bleaching solutions or bleach-fixers as used herein, bleaching agents having weak bleaching power are used. Examples of such bleaching agents are iron (III) ion complexes, which are the complexes of iron (III) ion and chelating agents, e.g., aminopolycarboxylic acid, aminopolyphosphoric acid, and their salts. These aminopolycarboxylic acid salts or aminopolyphosphoric acid salts are the alkali metal, ammonium, or water-soluble amine salts of aminopolycarboxylic acid or aminopolyphosphoric acid. Alkali metals include sodium, potassium, and lithium. Water-soluble amines include alkylamines, such as methylamine, diethylamine, triethylamine, and butylamine, alicyclic amines, such as cyclohexylamine, arylamines, such as aniline and m-toluidine, and heterocyclic amines, such as pyridine, morpholine, and piperidine.

Typical examples of chelating agents, such as aminopolycarboxylic acid, aminopolyphosphoric acid, and their salts, are as follows:

Ethylenediaminetetraacetic acid;
Disodium ethylenediaminetetraacetate;
Diammonium ethylenediaminetetraacetate;
Tetra(trimethylammonium) ethylenediaminetetraacetate;
Tetrapotassium ethylenediaminetetraacetate;
Tetrasodium ethylenediaminetetraacetate;
Trisodium ethylenediaminetetraacetate;
Diethylenetriaminepentaacetic acid;
Pentasodium diethylenetriaminepentaacetate;
Ethylenediamine-N-(β-oxyethyl)-N,N',N'-triacetic acid;
Trisodium ethylenediamine-N-(β-oxyethyl)-N,N',N'-triacetate;
Triammonium ethylenediamine-N-(β-oxyethyl)-N,N',N'-triacetate;
Propylenediaminetetraacetic acid;
Disodium propylenediaminetetraacetate;

Nitrilotriacetic acid;
Trisodium nitrilotriacetate;
Cyclohexanediaminetetraacetic acid;
Disodium cyclohexanediaminetetraacetate;
Iminodiacetic acid,
Dihydroxyethylglycine;
Ethyletherdiaminetetraacetic acid;
Glycoletherdiaminetetraacetic acid;
Ethylenediaminetetrapropionic acid;
Phenylenediaminetetraacetic acid;
1,3-Diaminopropanol-N,N', N'-tetramethylenephosphonic acid;
Ethylenediamine-N,N,N',N'-tetramethylenephosphonic acid; and
1,3-Propylenediamine-N,N,N',N'-tetramethylenephosphonic acid.

It is to be noted that the invention is not limited to the above-described compounds.

These iron (III) ion complex salts may be added in the form of complex salt. Alternatively, they may be formed in a solvent from iron (III) salts, such as ferric sulfate, ferric chloride, ferric nitrate, ammonium ferric sulfate, and ferric phosphate, and chelating agents, such as aminopolycarboxylic acid, aminopolyphosphoric acid, and phosphonocarboxylic acid. In the former case, one complex salt may be used, or two or more complex salts may be used in combination. In the latter case, one or more iron (III) salts may be used, and one or more chelating agents may be used. In either case, the chelating agent may be added in excess of the necessary amount to form the desired complex salt.

The bleaching solutions or bleach-fixers containing the above-described iron (III) ion complexes may contain complex salts of metals other than iron, e.g., cobalt and copper, or hydrogen peroxide.

Persulfuric acid salts for use in the bleaching solutions or bleach-fixers as used herein include alkali metal persulfuric acid salts, such as potassium persulfate and sodium persulfate, and ammonium persulfate. The bleach accelerators of the invention shows a greatly significant effect when used in combination with iron (III) ion complex salts although they are, of course, effective in combination with persulfuric acid salts.

The bleaching solutions as used herein can contain re-halogenation agents, e.g., bromides, such as potassium bromides, sodium bromide, and ammonium bromide, and chlorides, such as potassium chloride, sodium chloride, and ammonium chloride, as well as the bleaching agents, e.g., iron (III) ion complex salts, and the above-described compounds. In addition, known additives which are commonly used in the usual bleaching solutions, e.g., inorganic or organic acids and their salts having a pH buffering ability, can be added. These compounds include boric acid, borax, sodium methaborate, acetic acid, sodium sulfate, sodium carbonate, potassium carbonate, phosphorous acid, phosphoric acid, sodium phosphate, citric acid, sodium citrate, and tartaric acid. They can be used alone or in combination with each other.

The amount of the bleaching agent added is from 0.1 to 2 moles per liter of the bleaching solution. The pH of the bleaching solution is, in use, from 3.0 to 8.0 and preferably from 4.0 to 7.0 in the case of iron (III) ion complex salts.

In the bleach-fixers which are used in the present invention, the usual fixing agents, i.e., water-soluble silver halide-dissolving agents, e.g., thiosulfuric acid salts, such as sodium thiosulfate, ammonium thiosulfate, ammonium sodium thiosulfate, and potassium thiosulfate; thiocyanic acid salts, such as sodium thiocyanate, ammonium thiocyanate, and potassium thiocyanate; thioether compounds, such as ethylenebisthioglycolic acid, and 3,6-dithia-1,8-octanediol; and thioureas, can be used alone or in combination with each other. In addition, bleach-fixers having a specific composition, e.g., those bleach-fixers comprising the fixing agents described in Japanese Patent Application (OPI) No. 155354/80 and a large amount of halogen compound, such as potassium iodide, can be used.

In connection with the proportion of each component in the bleach-fixers, it is preferred that the amount of the iron (III) ion complex salt is from 0.1 to 2 moles and the amount of the fixing agent is from 0.2 to 4 moles, both being per liter of the bleach-fixer.

To the bleach-fixers can be added the above-described additives and preservatives that can be added to the bleaching solutions, e.g., sulfurous acid salts, such as sodium sulfite, potassium sulfite, and ammonium sulfite, and bisulfite adducts of hydroxylamine, hydrazine, and aldehyde compounds, such as acetoaldehyde sodium bisulfite. In addition, various fluorescent whiteners, defoaming agents, surfactants, organic solvents, e.g., methanol, and the known compounds having bleach-fix accelerating properties, e.g., polyamines described in Japanese Patent Publication No. 8836/70, thiourea derivatives described in Japanese Patent Publication No. 8506/70, iodides described in German Pat. No. 1,127,715, polyethyleneoxides described in German Pat. No. 966,410, nitrogen-containing heterocyclic compounds described in German Patent 1,290,812, and other thioureas, can be used in combination. The pH of the bleach-fixer is, in use, usually from 4.0 to 9.0 and preferably from 5.0 to 8.0.

In addition to the conventional primary aromatic amine-based color developers, the solution may further contain various additives which are commonly added to the usual color developers, e.g., alkali agents, such as sodium hydroxide, sodium carbonate, and potassium carbonate, alkali metal sulfites, alkali metal disulfites, alkali metal thiocyanates, alkali metal halides, benzyl alcohol, hard water-softening agents, and thickeners. The pH of the color developer is usually at least 7 and most commonly from about 9 to about 13.

As the black and white developer for use in the color reversal processing, those developers called black and white first developers which are commonly used in the reversal processing of color light-sensitive materials, and those developers which are used in processing black and white light-sensitive materials can be used. Various additives which are generally added to the usual black and white developers can be incorporated.

Typical additives include developing agents, e.g., 1-phenyl-3-pyrazolidone, Metol, and hydroquinone, preservatives, e.g., sulfites, accelerators comprising alkalis such as sodium hydroxide, sodium carbonate, and potassium carbonate, inorganic or organic inhibitors, e.g., potassium bromide, and 2-methylbenzimidazole, and methylbenzthiazole, hard water-softening agents, e.g., polyphosphoric acid salts, and development inhibitors comprising small amounts of iodides, and mercapto compounds.

In the bleaching solution or bleach-fixing bath, or its pre-bath as used herein, various bleach accelerators can be used although it is not essential. For example, bleach-accelerators, e.g., mercapto compounds and dithiocarbamate compounds described in U.S. Pat. Nos.

3,707,374, 3,772,020 and 3,893,858, Japanese Patent Publication No. 28227/76, Japanese Patent application (OPI) Nos. 94927/78, 95631/78 and 25064/80, and *Research Disclosure,* 15704 (May, 1977), can be used.

Fixers having those compositions which are generally used can be used. Fixing agents which can be used include thiosulfates and thiocyanates. In addition, organic sulfur compounds which are known to be effective as fixing agents can be used. These fixers may contain water-soluble aluminum salts as hardening agents.

The following examples are given to illustrate the invention in greater detail.

EXAMPLE 1

A multi-layer color light-sensitive material was produced by providing a cellulose triacetate film support with the following layers:

1st Layer: Antihalation Layer

A mixture of 1 kg of a black colloidal silver emulsion (containing 15 g of blackened silver and 100 g of gelatin per kilogram of the emulsion) and 40 ml of a 5% by weight aqueous solution of a coating agent, sodium p-dodecylbenzene sulfonate, was coated in a dry film thickness of 2μ.

2nd Layer: Gelatin Intermediate Layer (dry film thickness, 1.0μ):

3rd Layer: Red-Sensitive Low Sensitivity Silver Halide Emulsion Layer:

A silver iodobromide emulsion (mean grain size of $Ag_2BrI$, 0.3μ; containing 100 g of silver halide and 70 g of gelatin per kilogram of the emulsion) containing 5 mol% of iodine was prepared in the usual manner. To 1 kg of the thus-prepared emulsion were added 210 ml of a 0.1% methanol solution of anhydro-5,5-dichloro-9-ethyl-3,3'-di(3-sulfopropyl)thiacarbocyanine hydroxide pyridinium sulfite as a red-sensitive spectral sensitizer, and then, 20 ml of a 5% by weight aqueous solution of 5-methyl-7-hydroxy-2,3,4-triazaindolizine, 400 g of Cyan Coupler Emulsion (1), and 200 g of Emulsion (2) as described hereinafter. Then, 200 ml of a 2% aqueous solution of Colored Cyan Coupler (CC-1) was added, and further, 30 ml of a 2% by weight aqueous solution of sodium 2-hydroxy-4,6-dichlorotriazine as a gelatin hardening agent was added to prepare the red-sensitive low sensitivity silver halide emulsion. This emulsion was coated in a dry film thickness of 3.5μ

CC-1

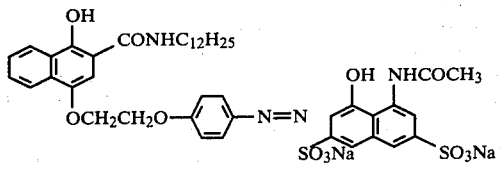

Emulsion (1)

A mixture consisting of:

| | |
|---|---|
| sodium p-dodecylbenzenesulfonate | 5 g |
| tricresyl phosphate | 60 ml |
| Cyan Coupler (C-101) | 70 g |
| ethyl acetate | 100 ml |

was dissolved at 55° C., and added to 1,000 g of a 10% by weight aqueous solution of gelatin which had been previously heated to 55° C. The resulting mixture was emulsified in a colloid mill to prepare Emulsion (1).

C-101

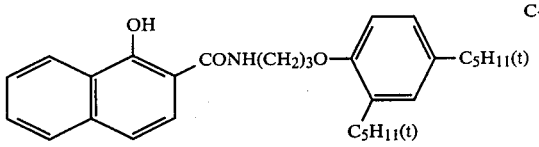

Emulsion (2)

A mixture consisting of:

| | |
|---|---|
| sodium p-dodecylbenzenesulfonate | 5 g |
| tricresyl phosphate | 60 ml |
| Cyan Coupler (C-101) | 70 g |
| DIR compound (D-1) | 10 g |
| ethyl acetate | 100 ml |

was dissolved at 55° C., and added to 1,000 g of a 10% by weight aqueous solution of gelatin which had been previously heated to 55° C. The resulting mixture was emulsified in a colloid mill to prepare Emulsion (2).

D-1

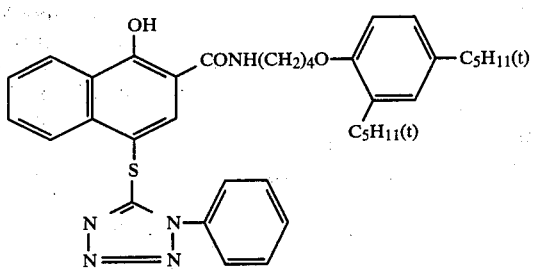

4th Layer: Red-Sensitive High Sensitivity Silver Halide Emulsion Layer:

A silver halide emulsion was prepared in the same manner as in the preparation of 3rd Layer, red-sensitive low sensitivity siler halide emulsion layer, except that the following modifications were made:

| | |
|---|---|
| Mean grain size of silver halide | 0.9μ |
| Amount of red-sensitive sensitizing agent being added | 140 ml |
| Emulsion (1) | 220 g |
| Emulsion (2) | 30 g |

The thus-prepared silver halide emulsion was coated in a dry film thickness of 2.2μ.

5th Layer: Gelatin Intermediate Layer (dry film thickness, 0.8μ):

6th Layer: Green-Sensitive Low Sensitivity Silver Halide Emulsion Layer:

To 1 kg of the same silver iodobromide emulsion as used in the preparation of 3rd Layer were added 180 ml of a 0.1% by weight methanol solution of 3,3'-di(2-sulfoethyl)-9-ethylbenzooxacarbocyanine pyridinium salt and 20 ml of a 5% by weight aqueous solution of 5-methyl-7-hydroxy-2,3,4-triazaindolizine in order as green-sensitive sensitizing dyes, and then, 320 g of Magenta Coupler Emulsion (3) and 180 g of Emulsion (4) as described hereinafter. In addition, 50 ml of a 2% by weight aqueous solution of 2-hydroxy-4,6-dichlorotriazine sodium salt as a gelatin hardening agent was added to prepare a green sensitive low sensitivity silver halide emulsion. This emulsion was coated in a dry film thickness of 3.2μ.

7th Layer: Green-Sensitive High Sensitivity Silver Halide Emulsion Layer:

A silver halide emulsion was prepared in the same manner as in the preparation of 6th Layer, green-sensitive low sensitivity silver halide emulsion layer, except that the following alterations were made:

| | |
|---|---|
| Mean grain size of silver halide | 1.0μ |
| Iodine content of emulsion | 6.5 mol % |
| Amount of green-sensitive sensitizer being added | 100 ml |
| Emulsion (3) | 150 g |
| Emulsion (4) | 30 g |

The thus-prepared emulsion was coated in a dry film thickness of 2.2μ.

Emulsion (3)

A mixing consisting of:

-continued

| | |
|---|---|
| Ethyl acetate | 120 ml |

was dissolved at 55° C., and added to 1,000 g of a 10% by weight aqueous solution of gelatin which had been previously heated to 55° C. The resulting mixture was emulsified in a colloid mill.

Emulsion (4)

A mixture consisting of:

| | |
|---|---|
| sodium p-dodecylbenzenesulfonate | 5 g |
| Tricresyl phosphate | 80 ml |
| Magenta Coupler (M-101) | 50 g |
| Colored Magenta Coupler (CM-1) | 10 g |
| DIR compound (D-2) | 15 g |
| ethyl acetate | 120 ml |

was dissolved at 55° C., and added to 1,000 g of a 10% by weight aqueous solution of gelatin which had been previously heated to 55° C. The resulting mixture was emulsified in a colloid mill.

M-101

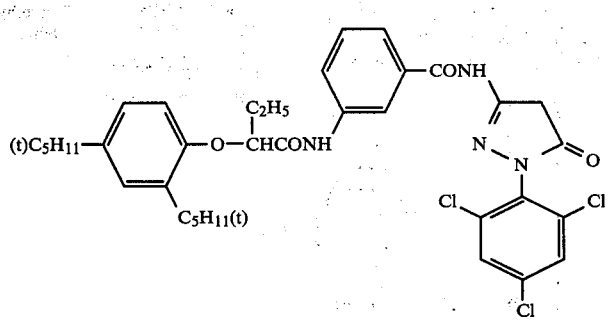

CM-1

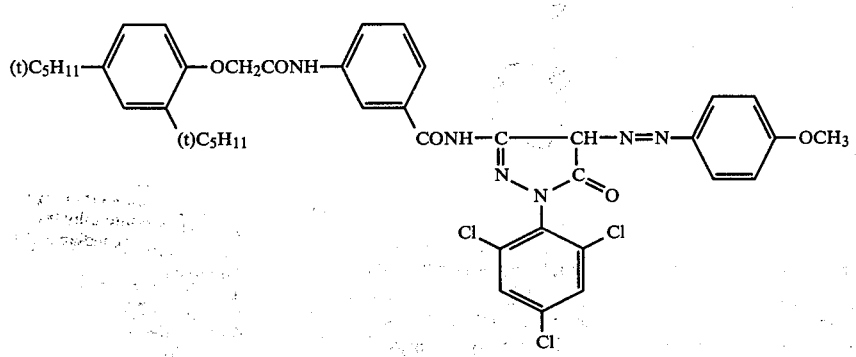

D-2

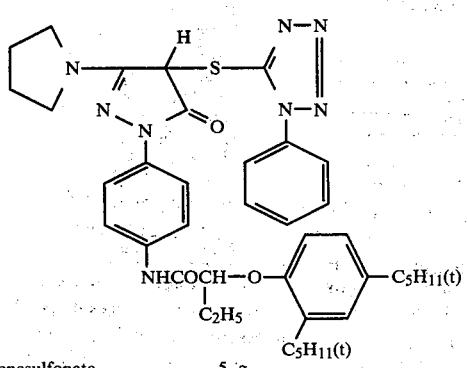

| | |
|---|---|
| sodium p-dodecylbenzenesulfonate | 5 g |
| Tricresyl phosphate | 80 ml |
| Magenta Coupler (M-101) | 50 g |
| Colored Magenta Coupler (CM-1) | 10 g |

8th Layer: Yellow Colloidal Silver Layer (dry film thickness, 1.6μ):

9th Layer: Blue-Sensitive Low Sensitivity Silver Halide Emulsion Layer:

To 1 kg of the same silver iodobromide emulsion as used in the preparation of 3rd layer except that the mean grain size was 0.5μ were added 20 ml of a 5% by weight aqueous solution of 5-methyl-7-hydroxy-2,3,4-triazaindolizine and 1,500 g of Yellow Coupler Emulsion (5) as described hereinafter. In addition, 50 ml of a 2% by weight aqueous solution of sodium 2-hydroxy-4,6-dichlorotriazine as a gelatin hardening agent was added to prepare a blue-sensitive low sensitivity silver halide emulsion.

This emulsion was coated in a dry film thickness of 3.0μ.

Emulsion (5)

A mixture consisting of:

| | |
|---|---|
| sodium p-dodecylbenzenesulfonate | 5 g |
| tricresyl phosphate | 80 ml |
| Yellow Coupler (Y-1) | 100 g |
| Ethyl acetate | 120 ml |

was dissolved at 55° C., and added to 1,000 g of a 10% by weight aqueous solution of gelatin which had been previously heated to 55° C. The resulting mixture was emulsified in a colloid mill.

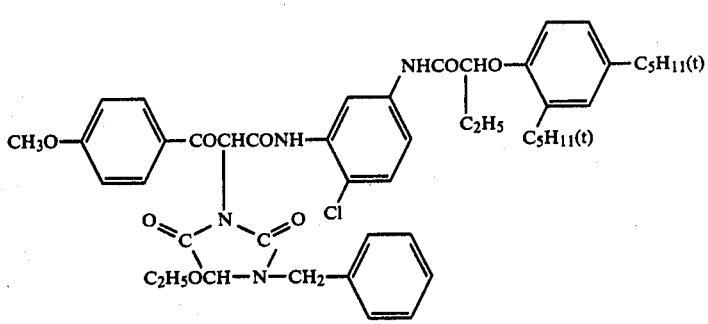

Y-1

10th Layer: Blue-Sensitive High Sensitivity Silver Halide Emulsion Layer:

A siliver halide emulsion was prepared in the same manner as in the preparation of the 9th Layer, blue-sensitive low sensitivity silver emulsion layer, except that the following alterations were made:

| | |
|---|---|
| Mean grain size of silver halide | 1.1μ |
| Emulsion (5) | 300 g |

The thus-prepared silver halide emulsion was coated in a dry film thickness of 2.5μ.

11th Layer: Gelatin Protective Layer (dry film thickness, 1.5μ):

The thus-prepared color light-sensitive materials is designated as Sample 1. The total amount of silver coated in Sample 1 was 7.5 g/m$^2$.

A series of color light-sensitive materials, Samples 2 to 8, were produced in the same manner as in the preparation of Sample 1 except that the compounds of the invention as shown in Table 1 were each added to the antihalation layer as a 0.1% by weight aqueous solution in the amount of $1.5\times10^{-5}$ mole/m$^2$.

The thus-produced color light-sensitive materials were each exposed to light through a wedge of 25CMS adjusted in color temperature to 4,800° K. by a filter by the use of a tungsten light source and, thereafter, processed at 38° C. according to the following steps:

| | |
|---|---|
| 1. Color development | 3.25 min |
| 2. Bleaching | 4.33 min |
| 3. Fixing | 4.33 min |
| 4. Water-washing | 3.25 min |
| 5. Stabilization | 0.5 min |

The composition of the processing solution used at each step was as follows:

| | |
|---|---|
| Color Developer | |
| Trisodium nitrilotriacetate | 1.9 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—ethyl-N—β-hydroxyethyl-amino)-2-methylaniline sulfate | 4.5 g |
| Water to make | 1 liter |
| (pH, 10.0) | |
| Bleaching Solution | |
| Iron (III) ammonium ethylenediaminetetraacetate dihydrate | 100.0 g |
| Disodium ethylenediaminetetraacetate | 8.0 g |
| Ammonium bromide | 150.0 g |
| Sodium nitrate | 20.0 g |
| Water to make | 1.0 liter |
| (pH, 6.0) | |
| Fixer | |
| Sodium tetrapolyphosphate | 2.0 g |
| Sodium sulfite | 4.0 g |
| Aqueous ammonium thiosulfate solution (70%) | 175.0 ml |
| Sodium disulfite | 4.6 g |
| Water to make | 1.0 liter |
| (pH, 6.6) | |
| Stabilizing Solution | |
| Formalin water (40%) | 8.0 ml |
| Water to make | 1.0 liter |

With each color light-sensitive material subjected to the above-described processing, sensitivity, gradation, and fog were examined, and further, the amount of silver remaining at the maximum color density area was measured by X-ray fluorescent analysis. The results are shown in Table 1.

TABLE 1

| Sample No. | Compound of the Invention | Dmin B | Dmin G | Dmin R | G1.5 B | G1.5 G | G1.5 R | Relative Sensitivity B | Relative Sensitivity G | Relative Sensitivity R | Amount of Residual Silver ($\mu g/cm^2$) |
|---|---|---|---|---|---|---|---|---|---|---|---|
| 1 | None | 0.60 | 0.52 | 0.18 | 0.81 | 0.76 | 0.66 | 100 | 100 | 100 | 15.2 |
| 2 | Compound (I-b)-(2) | 0.60 | 0.52 | 0.18 | 0.81 | 0.76 | 0.66 | " | " | " | 1.2 |
| 3 | Compound (I-a)-(1) | 0.60 | 0.52 | 0.18 | 0.81 | 0.76 | 0.66 | " | " | " | 3.6 |
| 4 | Compound (I-a)-(9) | 0.61 | 0.52 | 0.18 | 0.80 | 0.76 | 0.65 | " | " | " | 6.8 |
| 5 | Compound (I-a)-(12) | 0.60 | 0.53 | 0.18 | 0.81 | 0.75 | 0.66 | " | " | " | 4.1 |
| 6 | Compound (I-b)-(16) | 0.60 | 0.53 | 0.18 | 0.81 | 0.75 | 0.66 | " | " | " | 2.0 |
| 7 | Compound (I-a)-(19) | 0.60 | 0.52 | 0.18 | 0.81 | 0.76 | 0.65 | " | " | " | 3.5 |
| 8 | Compound (I-a)-(25) | 0.60 | 0.52 | 0.18 | 0.80 | 0.76 | 0.66 | " | " | " | 4.7 |

It can be seen from Table 1 that the addition of the compounds of the invention to the antihalation layer greatly accelerates desilvering and exerts almost no adverse influences on the photographic characteristics.

Compound (II)-2 of the general formula (II) was added to the yellow filter layer of Sample 2 in an amount of 2.1 moles per mole of colloidal silver, and the resulting color light-sensitive material was stored under the conditions of high temperature and high humidity for a long period of time. With this color light-sensitive material, it has been found that the formation of fog in the adjacent layer (green-sensitive layer) could be greatly prevented without the deterioration of desilvering properties compared with a comparative color light-sensitive material in which an equal amount of known antifoggant (e.g., 1-phenyl-5-mercaptotetrazole) was added.

EXAMPLE 2

The procedure of Example 1 was repeated with the exception that the bleaching and fixing procedures were not performed separately, but combined together; i.e., a monobath treatment was performed using a bleach-fixer as described hereinafter for 6.5 minutes. The amount of silver remaining at the maximum color density area was measured by X-ray fluorescent analysis. The results are shown in Table 2.

| Bleach-Fixer | |
|---|---|
| Iron (III) ammonium ethylenediamine-tetraacetate dihydrate | 100.0 g |
| Disodium ethylenediaminetetraacetate dihydrate | 5.0 g |
| Sodium sulfite | 10.0 g |
| Aqueous solution of ammonium thiosulfate (70% by weight) | 170.0 ml |
| Water to make (pH, 6.9) | 1.0 liter |

TABLE 2

| Sample No. | Compound of the Invention | Amount of Residual Silver ($\mu g/cm^2$) |
|---|---|---|
| 9 | none | 70.4 |
| 10 | Compound (I-b)-(3) | 1.8 |
| 11 | Compound (I-a)-(5) | 4.S |
| 12 | Compound (I-a)-(11) | 9.3 |
| 13 | Compound (I-a)-(14) | 7.2 |
| 14 | Compound (I-b)-(17) | 2.0 |
| 15 | Compound (I-a)-(25) | 3.8 |

As apparent from Table 2, even though the color light-sensitive materials containing the compounds of the invention were subjected to a bleach-fixing treatment, desilvering is greatly accelerated.

Furthermore, it has been found that the bleach-fixing treatment exerted no adverse influences on the photographic characteristics.

EXAMPLE 3

The procedure of Example 1 was repeated with the exception that a photographic processing comprising the following steps was applied. The amount of residual silver after the processing was measured by the same method as in Example 1. The results are shown in Table 3.

| Photographic Processing Step | Temperature (°C.) | Time (min) |
|---|---|---|
| 1. Color development | 41 | 3 |
| 2. Stopping | 38 | 0.5 |
| 3. Desilvering accelerating bath | " | " |
| 4. Bleaching | " | 1 |
| 5. Water-washing | " | " |
| 6. Fixing | " | 2 |
| 7. Water-washing | " | " |
| 8. Stabilization bath | " | 1/6 |

The composition of the processing solution used at each step was as follows:

| | |
|---|---|
| Color Developer | |
| Sodium hydroxide | 2 g |
| Sodium sulfite | 2 g |
| Potassium bromide | 1.4 g |
| Sodium chloride | 1 g |
| Borax | 1 g |
| Hydroxylaminesulfate | 4 g |
| Disodium ethylenediaminetetra-acetate | 2 g |
| 4-Amino-3-methyl-N—ethyl-N—(β-hydroxyethyl)aniline mono-sulfate | 4 g |
| Water to make | 1 liter |
| Stopping Solution | |
| Water | 800 ml |
| Glacial acetic acid | 30 ml |
| Caustic soda | 1.65 g |
| Water to make | 1 liter |
| Desilvering Accelerating Bath | |
| Sodium sulfite (anhydrous) | 9.0 g |
| N,N—Dimethylaminoethylisothiourea dichloride | 2.5 g |
| Sodium acetate | 8.0 g |
| Glacial acetic acid | 2.3 ml |
| Water to make | 1 liter |
| Bleaching Solution | |
| Sodium persulfate | 60 g |
| Sodium chloride | 20 g |
| Sodium dihydrogenphosphate | 15 g |
| Sodium tetrapolyphosphate | 2 g |
| β-Alanine | 2 g |
| Phosphoric acid (85%) | 2.2 ml |
| Water to make | 1 liter |
| Fixer | |

-continued

| | |
|---|---|
| Sodium thiosulfate | 150 g |
| Sodium sulfite (anhydrous) | 15 g |
| Borax | 12 g |
| Glacial acetic acid | 15 ml |
| Water to make | 1 liter |
| Stabilizing Bath | |
| Formaldehyde (37%) | 10 ml |
| Water to make | 1 liter |

TABLE 3

| Sample No. | Compound of the Invention | Amount of Residual Silver ($\mu g/cm^2$) |
|---|---|---|
| 16 | none | 18.3 |
| 17 | Compound (I-b)-(3) | 3.1 |
| 18 | Compound (I-a)-(12) | 2.6 |
| 19 | Compound (I-a)-(15) | 4.1 |
| 20 | Compound (I-a)-(25) | 3.7 |

It can be seen from Table 3 that even when the bleaching solution containing persulfuric acid salt as a bleaching agent is used, the desilvering of the color light-sensitive material containing the compound of the invention is greatly accelerated.

Even though the desilvering accelerating bath was omitted, the color light-sensitive materials containing the compounds of the invention were greatly accelerated in desilvering compared with those color light-sensitive materials not containing the compounds of the invention.

Moreover, the bleaching using persulfates exerted no adverse influences on the photographic characteristics.

EXAMPLE 4

The following layers were provided in order on a cellulose acetate film provided with the usual subbing layer to prepare a color light-sensitive material, Sample 21.

1st Layer: Antihalation Layer:

Same as the 1st layer of Example 1.

2nd Layer: Intermediate Layer:

Same as the 2nd layer of Example 1.

3rd Layer: Red-Sensitive Low Sensitivity Silver Halide Emulsion Layer:

Same as the 3rd layer of Example 1.

4th Layer: Red-Sensitive Moderate Sensitivity Silver Halide Emulsion Layer:

A silver halide emulsion was prepared in the same manner as in the preparation of the 3rd layer of Example 1 except that the following alterations were made:

| | |
|---|---|
| Mean grain size of silver halide | 0.7μ |
| Amount of red-sensitive color sensitizer being added | 200 ml |
| Emulsion (1) | 300 g |
| Emulsion (2) | 80 g |

The thus-prepared silver halide emulsion was coated in a dry film thickness of 1.8μ.

5th Layer: Red-Sensitive High Sensitivity Silver Halide Emulsion Layer:

Same as the 4th layer of Example 1.

6th Layer: Gelatin Intermediate Layer:

Same as the 5th layer of Example 1.

7th Layer: Green-Sensitive Low Sensitivity Silver Halide Emulsion Layer:

Same as the 6th layer of Example 1.

8th Layer: Green-Sensitive Moderate Sensitivity Silver Halide Emulsion Layer:

A silver halide emulsion was prepared in the same manner as in the preparation of the 8th layer of Example 1 except that the following alterations were made:

| | |
|---|---|
| Mean grain size of silver halide | 0.7μ |
| Amount of Green-sensitive color sensitizer being added | 170 ml |
| Emulsion (3) | 200 g |
| Emulsion (4) | 50 g |

The thus-prepared silver halide emulsion was coated in a dry film thickness of 1.3μ.

9th Layer: Green-Sensitive High Sensitivity Silver Halide Emulsion Layer:

Same as the 7th layer of Example 1.

10th Layer: Yellow Colloidal Silver Layer:

Same as the 8th layer of Example 1.

11th Layer: Blue-Sensitive Low Sensitivity Silver Halide Emulsion Layer:

Same as the 9th layer of Example 1.

12th Layer: Blue-Sensitive Moderate Sensitivity Silver Halide Emulsion Layer:

A silver halide emulsion was prepared in the same manner as in the preparation of the 11th layer except that the following alterations were made:

| | |
|---|---|
| Mean grain size of silver halide | 0.8μ |
| Emulsion (5) | 480 g |

The thus-prepared silver halide emulsion was coated in a dry film thickness of 1.4μ.

13th Layer: Blue-Sensitive High Sensitivity Silver Halide Emulsion Layer:

Same as the 10th layer of Example 1.

14th Layer: Gelatin Protective Layer:

With the thus-prepared color light-sensitive material, Sample 21, the total amount of silver coated was 9.0 $g/m^2$.

A series of color light-sensitive materials, Samples 22 to 24, were prepared in the same manner as above except that the compounds shown in Table 4 were each added to the antihalation layer of Sample 21 as a 0.1% by weight aqueous solution in an amount of $1.5\times10^{-5}$ $mole/m^2$.

The thus-produced color light-sensitive materials were processed in the same manner as in Example 2, and the amount of residual silver after the processing was measured. The results are shown in Table 4.

TABLE 4

| Sample No. | Compound of the Invention | Amount of Residual Silver ($\mu g/cm^2$) |
|---|---|---|
| 21 | none | 78.6 |
| 22 | Compound (I-b)-(2) | 1.2 |
| 23 | Compound (I-a)-(7) | 5.3 |
| 24 | Compound (I-a)-(30) | 9.8 |

It can be seen from Table 4 that the addition of the compounds of the invention greatly accelerates desilvering.

While the invention has been described in detail and with reference to specific embodiments thereof, it will be apparent to one skilled in the art that various changes and modifications can be made therein without departing from the spirit and scope thereof.

What is claimed is:

1. In a color photographic silver halide light-sensitive material having at least one light sensitive silver halide emulsion layer containing color-forming coupler(s); the improvement wherein the light-sensitive material has at least one layer containing at least one compound selected from the group consisting compounds represented by the general formulae (I-a) and (I-b):

Formula (I-a)

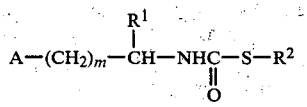

Formula (I-b)

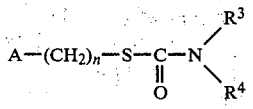

wherein A represents an amino group or a nitrogen-containing heterocyclic radical, which may be substituted; $R^1$ represents a hydrogen atom or a carboxyl group; $R^2$ represents a monovalent metal atom, an ammonium group, an alkyl group which may be substituted, a group

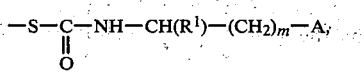

or a group

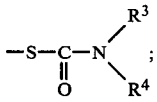

$R^3$ and $R^4$ each represent a hydrogen atom, or an alkyl group which may be substituted by a hydroxyl group, an alkoxy group, a halogen atom, a carboxyl group, a group $—SO_2H$, a group $—SO_3H$, or the group represented by A; m is 1 or 2; and n is an integer of from 2 to 4.

2. A color photographic silver halide light sensitive material as claimed in claim 1, wherein $R^2$ is an alkali metal selected from the group consisting of Na, Li and K.

3. A color photographic silver halide light sensitive material as claimed in claim 1, wherein A is an amino group substituted by at least one alkyl group containing from 1 to 3 carbon atoms.

4. A color photographic silver halide light sensitive material as claimed in claim 3, wherein said alkyl group is substituted by a group selected from the group consisting hydroxyl group, a methoxy group and an ethoxy group.

5. A color photographic silver halide light sensitive material as claimed in claim 1, wherein A is a 5- or 6-membered nitrogen-containing heterocyclic radical.

6. A color photographic silver halide light sensitive material as claimed in claim 5, wherein said heterocyclic radical is a saturated heterocyclic radical.

7. A color photographic silver halide light sensitive material as claimed in claim 6, wherein said saturated heterocyclic radical is a radical selected from the group consisting pyrrolidine, piperidine, piperadine and morpholine radicals.

8. A color photographic silver halide light sensitive material as claimed in claim 5, wherein said heterocyclic radical is an unsaturated heterocyclic radical.

9. A color photographic silver halide light sensitive material as claimed in claim 8, wherein said unsaturated heterocyclic radical is a radical selected from the group consisting imidazole, triazole, and indole radicals.

10. A color photographic silver halide light sensitive material as claimed in claim 5, wherein said heterocyclic radical is substituted by an alkyl group containing from 1 to 3 carbon atoms.

11. A color photographic silver halide light sensitive material as claimed in claim 10, wherein said alkyl group is substituted by a group selected from the group consisting hydroxy group, a methoxy group and an ethoxy group.

12. A color photographic silver halide light sensitive material as claimed in claim 1, wherein $R^2$, $R^3$ and $R^4$ are each an alkyl group containing 1 to 5 carbon atoms.

13. A color photographic silver halide light sensitive material as claimed in claim 12, wherein said alkyl group is substituted by a group selected from the group consisting halogen, hydroxyl group, alkoxy group, carboxyl group, $—SO_3H$ and $—SO_2H$.

14. A color photographic silver halide light sensitive material as claimed in claim 12, wherein said $R^2$, $R^3$ and $R^4$ each represents a group selected from the group consisting $—CH_2—CH_2—A$, $—C(CH_2)_3—A$, $—CH_2SCONHCH(R^1)(CH_2)_m—A$, $—CH_2CH(OH)CH_2SCONHCH(R^1)(CH_2)_m—A$, and $—(CH_2)_2SO_2(CH_2)_2—SCONHCH(R^1)(CH_2)_m—A$, wherein A represents the same group as defined in claim 1.

15. A color photographic silver halide light sensitive material as claimed in claim 1, wherein said compound is contained in the layer in an amount within the range of $1\times10^{-7}$ to $1\times10^{-3}$ mole/m$^2$.

16. A color photographic silver halide light-sensitive material as claimed in claim 1, wherein at least one layer contains a compound represented by the general formula (II)

(II)

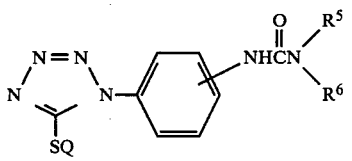

wherein Q is a hydrogen atom, an alkali metal atom, or a quaternary ammonium group; and $R^5$ and $R^6$ are each a hydrogen atom, an unsubstituted or substituted aliphatic group, or an unsubstituted or substituted aromatic group, an $R^5$ and $R^6$ may be the same or different and may combine together to form a ring.

17. A color photographic silver halide light-sensitive material as claimed in claim 16, wherein Q is an alkali metal selected from the group consisting $Li^{\oplus}$, $Na^{\oplus}$ and $K^{\oplus}$.

18. A color photographic silver halide light sensitive material as claimed in claim 16, wherein Q is a quaternary ammonium group selected from the group consisting $H_4N^{\oplus}$, $(CH_3)_4N^{\oplus}$, $(C_4H_9)_4N^{\oplus}$, $n—C_{12}H_{25}(CH_3)_3N^{\oplus}$, $n—C_{16}H_{33}(CH_3)_3N^{\oplus}$ and $Ph—CH_2(CH_3)_3N^{\oplus}$.

19. A color photographic silver halide light sensitive material as claimed in claim 16, wherein $R^5$ and $R^6$ are each a group selected from the group consisting an alkyl group and an alkenyl group containing up to 18 carbon atoms.

20. A color photographic silver halide light sensitive material as claimed in claim 16, wherein $R^5$ and $R^6$ are each an aryl group containing 6 to 20 carbon atoms.

21. A color photographic silver halide light sensitive material as claimed in claim 16, wherein $R^5$ and $R^6$ are combined together to form a ring containing 2 to 10 carbon atoms.

22. A color photographic silver halide light sensitive material as claimed in claim 21, wherein said ring contains at least one atom selected from the group consisting O, N and S.

23. A color photographic silver halide light sensitive material as claimed in claim 16, wherein the substituent of said aliphatic and aromatic groups are each a group selected from the group consisting alkoxy group, halogen, an alkyl group, a phenyl group, an alkoxycarbonyl group, an acyl group, an acyloxy group, a cyano group, a nitro group, an alkylthio group, an amido group and a sulfonamido group.

24. A color photographic silver halide light sensitive material as claimed in claim 16, wherein the compound represented by the general formula (II) is present in an amount within the range of $10^{-2}$ to $10^2$ moles/mole of silver.

25. A color photographic silver halide light sensitive material as claimed in claim 1, which has a subbing layer, at least one intermediate layer, at least one silver halide emulsion layer, a yellow filter layer, an antihalation layer and a protective layer.

26. A color photographic silver halide light sensitive material as claimed in claim 25, wherein at least one of antihalation and yellow filter layers contains colloidal silver and at least one compound selected from the group consisting compounds represented by the general formulae (I-a) and (I-b).

27. A color photographic silver halide light sensitive material as claimed in claim 16, wherein the compound represented by the general formula (II) is contained in the same layer as the layer containing at least one compound selected from the group consisting compounds represented by the general formulae (I-a) and (I-b).

28. A color photographic silver halide light sensitive material as claimed in claim 16, wherein the compound represented by the general formula (II) is contained in the layer wherein the compound represented by the general formula (I-a) or (I-b) is not contained.

29. A color photographic silver halide light sensitive material as claimed in claim 1, wherein silver is present in an amount of 30 mg/100 $cm^2$.

30. A color photographic silver halide light-sensitive material claimed in claim 25, wherein at least one silver halide emulsion layer contains at least one compound selected from the group consisting compounds represented by the general formula (I-a) and (I-b).

* * * * *